US008712091B2

(12) United States Patent
Taylor et al.

(10) Patent No.: US 8,712,091 B2
(45) Date of Patent: Apr. 29, 2014

(54) LOUDSPEAKER GRILLE

(75) Inventors: Garry Taylor, Cardiff (GB); Andrew Holt, Cumbria (GB)

(73) Assignee: Harman International Industries Ltd., Hertfordshire (GB)

( * ) Notice: Subject to any disclaimer, the term of this patent is extended or adjusted under 35 U.S.C. 154(b) by 0 days.

(21) Appl. No.: 13/481,287

(22) Filed: May 25, 2012

(65) Prior Publication Data

US 2012/0321121 A1 Dec. 20, 2012

(51) Int. Cl.
*H04R 1/02* (2006.01)

(52) U.S. Cl.
USPC ..... 381/391; 381/386; 381/345

(58) Field of Classification Search
USPC ..... 381/391, 345, 386; D14/172, 204, 205, D14/209, 210, 212, 213, 214, 215, 216; 181/224
See application file for complete search history.

(56) References Cited

U.S. PATENT DOCUMENTS

| | | | | |
|---|---|---|---|---|
| 2,750,245 | A * | 6/1956 | Macintyre John A | 312/7.2 |
| 3,679,023 | A | 7/1972 | Rankin | 181/31 A |
| 3,909,530 | A * | 9/1975 | Gosswiller | 381/342 |
| 3,989,909 | A | 11/1976 | Hodsdon et al. | 179/184 |
| 3,995,125 | A | 11/1976 | Cypser | 179/184 |
| 4,424,881 | A * | 1/1984 | Hattori | 181/155 |
| 6,215,885 | B1 * | 4/2001 | Geiger | 381/386 |
| 6,975,740 | B2 | 12/2005 | Rautio et al. | 381/386 |
| 7,840,021 | B2 * | 11/2010 | Greco et al. | 381/334 |
| 2005/0087392 | A1 * | 4/2005 | Flanders et al. | 181/156 |
| 2006/0177089 | A1 | 8/2006 | Greco et al. | 381/391 |

FOREIGN PATENT DOCUMENTS

| | | |
|---|---|---|
| DE | 849 253 | 9/1952 |
| JP | 07-107579 | 4/1995 |
| JP | 07-226988 | 8/1995 |
| JP | 09-327082 | 12/1997 |
| JP | 2001-128272 A | 5/2001 |

OTHER PUBLICATIONS

Extended European Search Report issued in European Patent Application No. 11168086.4, dated Oct. 20, 2011 (6 pgs.).

* cited by examiner

*Primary Examiner* — Curtis Kuntz
*Assistant Examiner* — Joshua A Kaufman
(74) *Attorney, Agent, or Firm* — Brooks Kushman P.C.

(57) ABSTRACT

A loudspeaker grille is disclosed. In accordance with one example, a loudspeaker grille includes a louver arrangement to be arranged in front of a chassis of a loudspeaker to protect membrane and suspension thereof. The louver arrangement includes a first and a second louver arranged on opposing sides of a center plane. Both louvers include a plurality of fins which are arranged slanted with respect to the center plane and which are spaced such that a clearance is provided between projections of neighboring fins to the center plane. The fins of the first louver are inversely slanted to the fins of the second louver. Further, the fins of the first louver are shifted in a lateral direction within the to center plane with respect to the fins of the second louver.

21 Claims, 5 Drawing Sheets

LOUDSPEAKER GRILLE

BACKGROUND OF THE INVENTION

1. Priority Claim

This application claims the benefit of priority from European Patent Application No. 11 168 086.4, filed May 30, 2011, which is incorporated by reference.

2. Technical Field

The present invention relates generally to loudspeakers and, more particularly to loudspeaker grilles.

3. Related Art

Loudspeaker grilles are designed mainly to protect loudspeaker drivers from mechanical impact as well as to prevent ambient dust from accumulating on the diaphragms of the loudspeaker drivers. For this purpose, a loudspeaker grille or speaker grille is usually found on the front of many consumer and industrial loudspeakers. Certain conventional loudspeaker grilles are made of a piece of dark colored cloth stretched over a frame which is then attached to the enclosure of a loudspeaker. Such grilles are called "soft grilles". Alternatively, or additionally to the cloth, a rigid grille (usually called "hard grille") may be mounted directly over the face of the loudspeaker driver. Hard grilles provide a higher degree of protection and are thus usually used in ruggedized loudspeaker designs.

As mentioned above, the main purpose of the grille is to protect the driver element and loudspeaker internals (and possibly other audio components) from external objects while still allowing the sound to pass through clearly. However, because the grille is placed in the direct path of the loudspeaker driver, the grille interacts with the sound produced. A suitable compromise between protection and sound quality may need to be made based on the loudspeaker's application.

SUMMARY

A loudspeaker grille is disclosed. In accordance with one example, a loudspeaker grille includes a louver arrangement to be arranged in front of a chassis of a loudspeaker to protect membrane and suspension thereof. The louver arrangement can include a first and a second louver arranged on opposing sides of a center plane. Both louvers can include a plurality of fins arranged slanted with respect to the center plane and spaced such that a clearance is provided between projections of neighboring fins to the center plane. The fins of the first louver may be inversely slanted to the fins of the second louver. Further, the fins of the first louver can be shifted in a lateral direction within the center plane with respect to the fins of the second louver.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention.

DETAILED DESCRIPTION OF THE PREFERRED EMBODIMENTS

Figure 1:
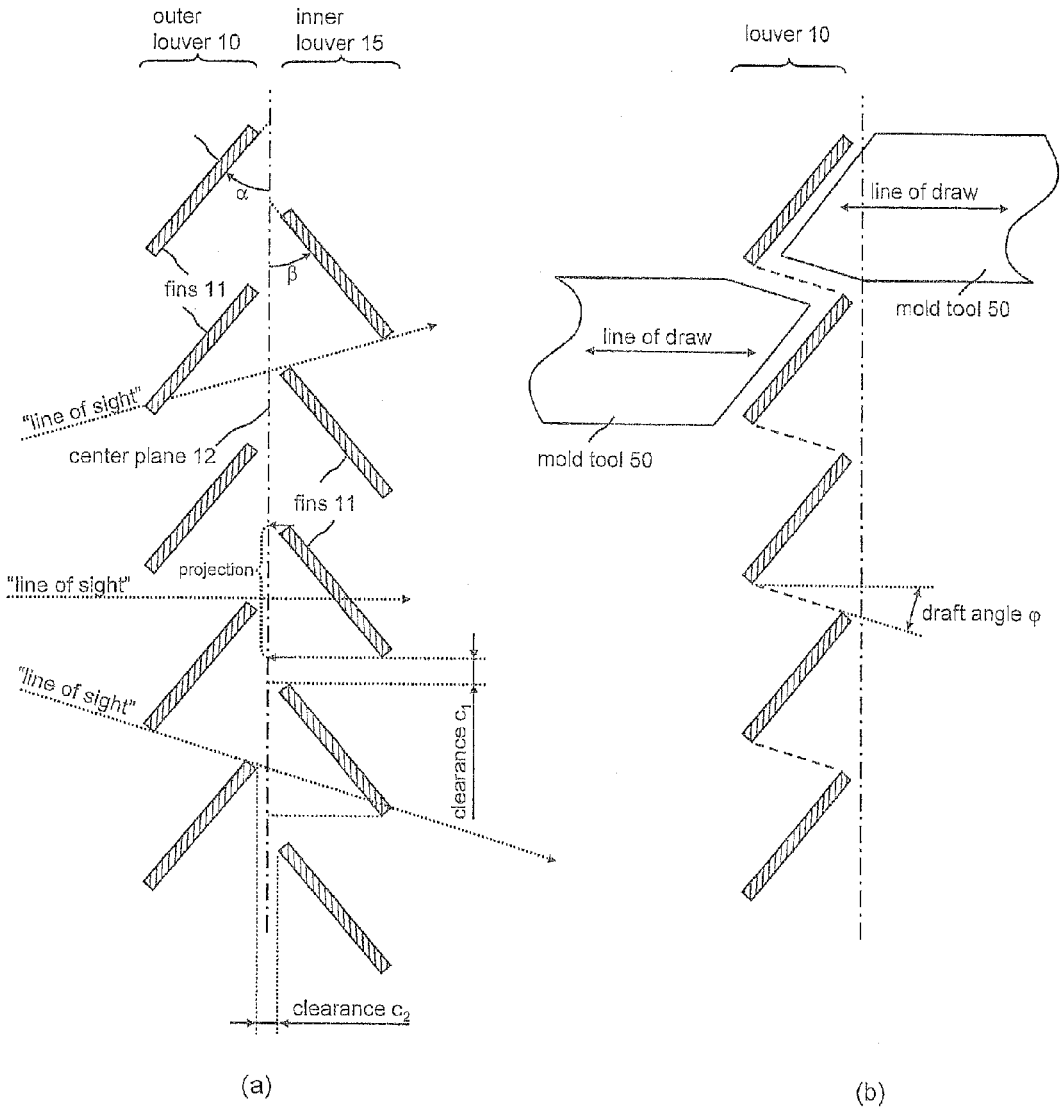
FIG. 1 is a schematic view of a cross-section through fins of louvers forming an example loudspeaker grille showing (a) a configuration of outer and inner louvers and (b) a method of making a louver.

When a high degree of protection of a loudspeaker against mechanical impact is sought, a hard (solid) loudspeaker grille may be required, in contrast to the soft grilles which may be typically found on standard loudspeaker boxes. Hard or solid grilles can be made from many types of construction material, including metal, wood or plastic. Some solid grilles are made from a board or sheet of material with holes drilled or cut in the board for the sound to pass through, while others are made from thin strips of material either cross-hatched together or equally spaced in parallel. In particular, when made from plastics, the loudspeaker grilles may be formed by molding, such as blow molding or thermoform molding.

Because hard material cannot move with the loudspeaker's sound, the loudspeaker's output level can be considered when designing the grille. A grille with more holes will allow more sound to pass but will offer less protection from small objects. A speaker with too much material in front of the driver will begin to distort the speaker's output at higher sound pressure levels.

In addition to the aforementioned protection against solid objects, a certain degree of protection against jets of water is often desirable. Although the membrane and the surround or suspension of a loudspeaker can be designed to be water resistant or even water proof, the mechanical impact of a jet of water directly hitting the membrane or the suspension can still damage the loudspeaker. Consequently, a loudspeaker grille which provides sufficient protection against liquid jets can be designed such that the impetus of any portions of a jet that might finally hit the loudspeaker is mainly absorbed in the grille, whereas other portions of the liquid jet are reflected or dispersed.

FIG. 1*a* is a partial schematic view of a cross-section through fins 11 of two louvers 10 and 15 which may be part of a loudspeaker grille. A first (outer) louver 10 and a second (inner) louver 15 are arranged on opposing sides of a center plane 12. Accordingly, the two louvers 10 and 15 are arranged substantially parallel to the center plane 12 (and thus parallel to each other). When mounted, the louvers 10 and 15 protect the loudspeaker. The loudspeaker may face the inner louver 15, and every possible straight "line of sight" through the louvers 10 and 15 is obstructed by at least one fin 11 of one of the louvers 10 and 15 and the orientation with respect to the center plane 12 the "line of sight" might have.

Each louver 10, 15 can be a separate member that includes a plurality of fins 11. Alternatively, the louvers 10, 15 may be formed as a single member. The fins 11 of each louver 10, 15 may extend across each louver 10, 15 in a substantially same direction. For example, the fins of the first louver 10 may extend in a first direction and the fins of the second louver 15 extend in a second direction that is substantially parallel to the first direction. The plurality of fins 11 of each louver 10, 15 can be arranged slanted with respect to the center plane 12 and which are spaced such that a clearance $c_1$ is provided between projections of neighboring fins to the center plane. The clearance $c_1$ between the fins may vary throughout a louver and may be different for the first and the second louver. However, the clearance $c_1$ can allow for a good transmission of sound pressure through the louvers without substantially deteriorating the acoustic performance of the loudspeaker. The resulting grille may be particularly well suited for broadband loudspeakers. As a consequence of the clearance $c_1$, the fins of one louver do not overlap in a direction perpendicular to the center plane 12 (which can be regarded as a negative clearance, $c_1 \geq 0$). That is, there is at least one "line of sight" perpendicular to the center plane 12 which is not obstructed by the fins of one of either the first or the second louver (the "line of sight" will be obstructed, however, by the fins of the first and the second louver together). In another example, the clearance $c_1$ can be zero ($c_1=0$), exactly one line of sight (having an infinitely small extension in a lateral direction) is not obstructed by the fins of a single louver. In particular, the (virtual) projections of the individual fins of a single louver (10 or 15) onto the center plane 12 do not overlap in a lateral direction within the center plane 12.

The fins of the first louver 10 are inversely slanted (with respect to the center plane 12) to the fins of the second louver 15. In the present example, the fins of the second louver 15 are slanted to form an angle $\alpha$ to the center plane, and $\alpha$ is defined to be positive as rotated counterclockwise out of the center plane 12. The fins of the first louver 10 are slanted to form an angle $\beta$ to the center plane 12 and 13 is defined to be negative as rotated clockwise out of the center plane 12. Thus, the fins of the two louvers 10, 15 are inversely slanted, whereby the slant angle may, for example, be of the same magnitude ($|\alpha|=|\beta|$) or substantially similar in both louvers. However, the angles $\alpha$ and $\beta$ may be arbitrarily, such as $|\alpha|\neq|\beta|$, chosen under the condition that any possible "line of sight" perpendicular to the center plane 12 is obstructed by the combination of the two louvers 10, 15. For example, $\alpha$ and $\beta$ may be greater than 0 degrees and less than 90 degrees, between about 20 degrees and about 70 degrees, or between about 30 and about 60 degrees.

Further, the fins 11 of the first louver 10 can be shifted in a lateral direction, such as within the center plane 12 and perpendicular to a longitudinal axis of the fins 11, with respect to the fins of the second louver 15. As a consequence, any straight "line of sight," regardless of its incidence angle, which is not obstructed by the fins of the first louver 10 will be obstructed by the fins of the second louver 15. Simultaneously, the acoustic performance of the loudspeaker may be only marginally affected due to the "open" design of the louver arrangement including the inner and the outer louvers 10, 15. Thus, sound waves emitted by a loudspeaker that travel through the inner and outer louvers 10, 15 may remain substantially intact and unobstructed, even at elevated sound pressure levels, thereby minimizing distortion caused by the inner and outer louvers 10, 15.

As mentioned above, the louvers 10, 15 may be produced separately using a molding process. In this case, the above mentioned clearance $c_1$ allows for the use of a simple molding tool (see FIG. 1*b* for the first louver 10), as a draft angle $\phi$ is provided between neighboring fins 11 thus allowing the molding tools to be drawn back along a straight line perpendicular to the center plane (see FIG. 1*b*). For example, draft angle $\phi$ may be greater than zero. However, the draft angle $\phi$ may be zero.

After the molding process the two louvers may be assembled such that a clearance $c_2$ in a direction perpendicular to the center plane 12 is provided between the fins of the two louvers (see FIG. 1*a*). In one example, the clearance $c_2$ may be zero ($c_2=0$). However, a small clearance $c_2$ may contribute to an improved transmission of sound. Furthermore, at least one of the first and second louvers 10, 15 may comprise a first fin having a first edge and a second fin having a second edge that neighbors the first edge of the first fin. The first edge can be positioned a first distance from the center plane 12 and the second edge can be positioned a second distance from the center plane 12 different or substantially different from the first distance. For example, the first distance may be equal to $c_2/2$ and the second distance may be greater or substantially greater than $c_2/2$ such as greater than $c_2$.

Figure 2:
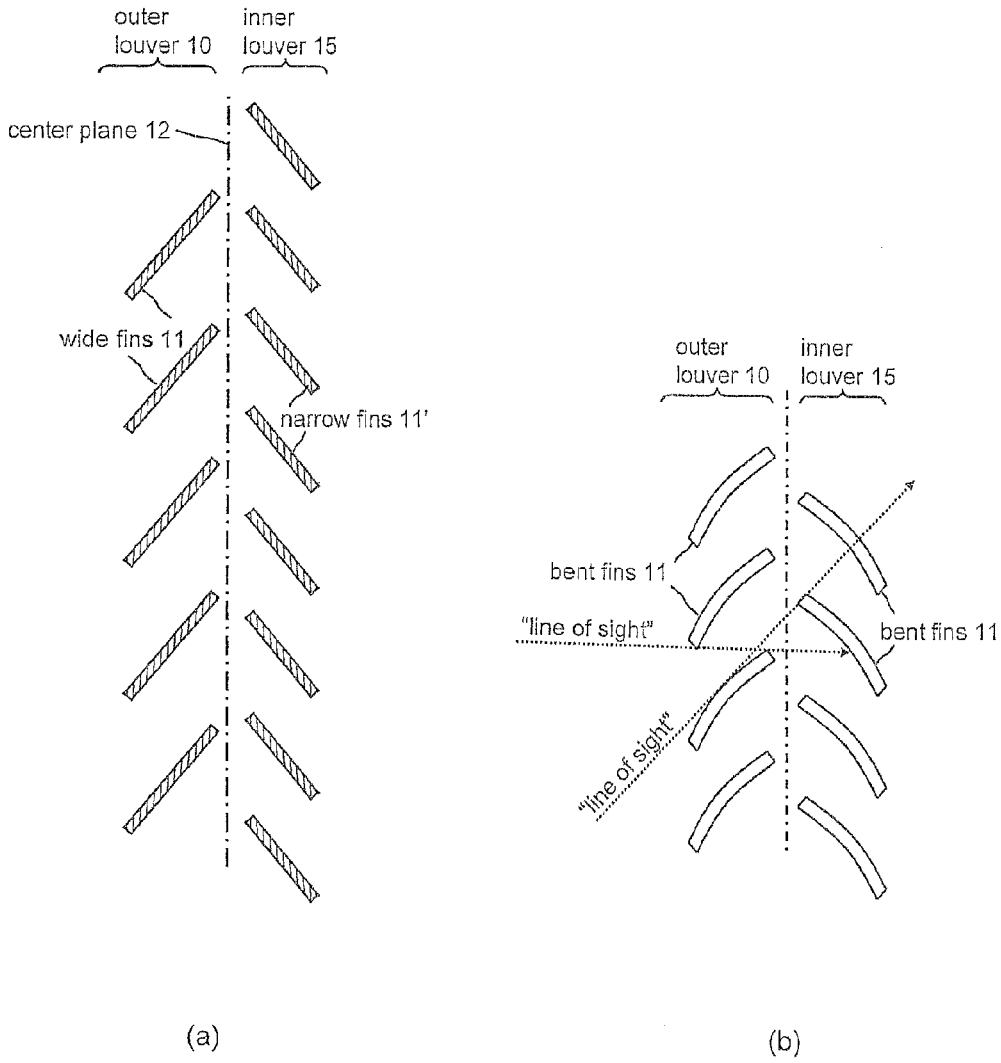
FIG. 2 is a schematic view of a cross-section through fins of louvers illustrating different examples of shapes of the fins where (a) the fins of the outer louver are wider than the fins of the inner louver and (b) the fins of the outer and inner louvers are bent.

FIG. 2 illustrates some variations of the louvers 10, 15 introduced with reference to FIG. 1. As illustrated in FIG. 2*a*, the lateral width of the fins 11 may by different for the first and the second louver 10, 15. In the present example, the fins 11 of the first louver 10 are wider than the (narrower) fins 11' of the second louver 15. Further, the width of the fins 11, 11' may vary throughout one louver.

The fins may be substantially planar. However, as illustrated in FIG. 2*b*, the fins are not necessarily planar. The fins 11 may be bent around their longitudinal axis thus exhibiting a curved cross-section. For example, the fins 11 may be concave or convex relative to the center plane 12. Furthermore, each of the fins 11 may have a slope relative to the center plane 12. The slope along an entire surface of the fins 11 of the first louver 10 may be positive, and the slope along an entire surface of the fins 11 of the second louver 15 may be negative. However, the relative positive and negative slopes of the fins 11 of the first and second louvers 10, 15 may be interchanged such that the slopes of the fins 11 of the first and second louvers 10, 15 have opposite signs (positive and negative). The fins 11 may be substantially flat strips whose sizes and forms may vary as illustrated in FIG. 2. However, the actual size and form of the fins may not be so important, provided that the fins of one louver are spaced and the fins of the two louvers are offset such that any "line of sight" is obstructed as discussed above with respect to FIG. 1.

Figure 3:
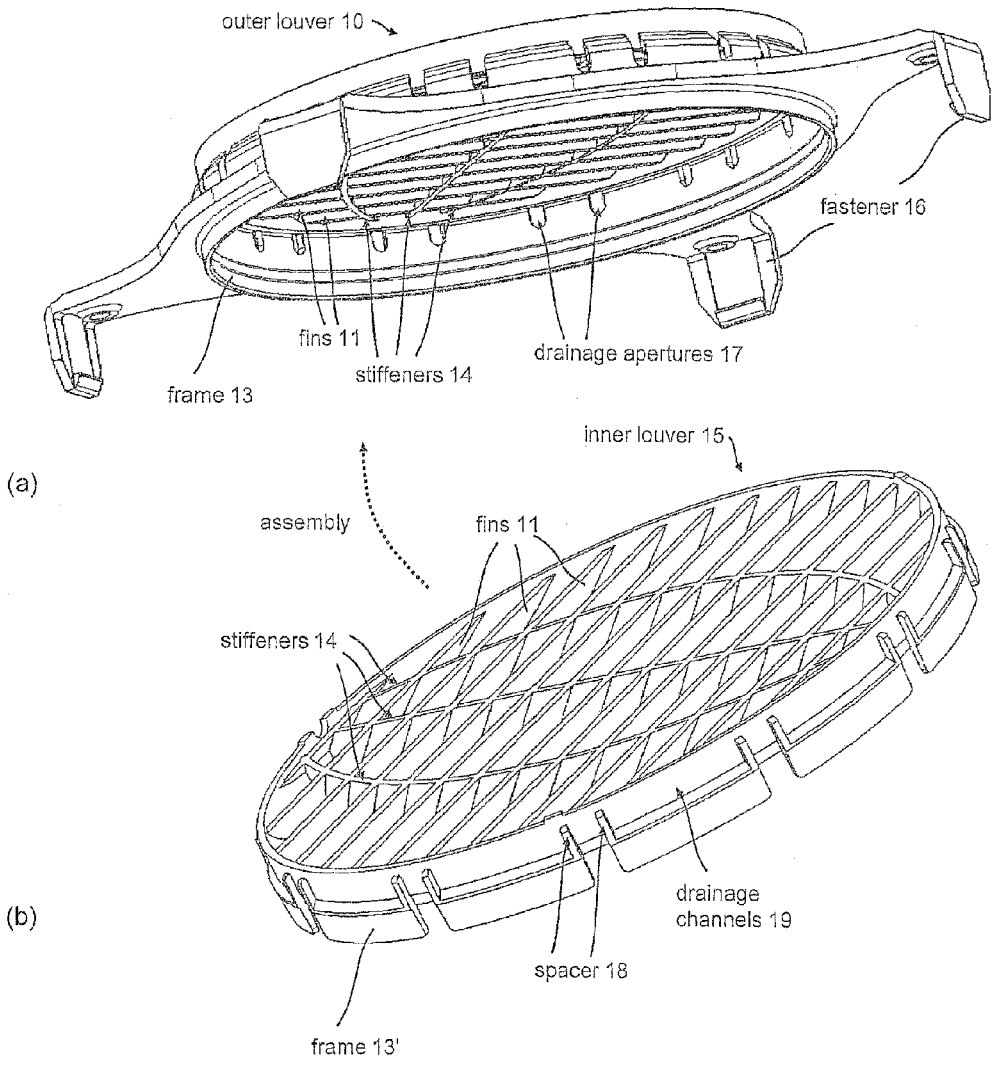
FIG. 3 is a perspective view of (a) an outer louver and (b) an inner louver that form an example loudspeaker grille.

Having now explained the principles, one detailed implementation of an exemplary loudspeaker grille in accordance with the present invention is discussed with respect to FIG. 3. Accordingly, the louvers 10 and 15 (see FIGS. 3*a* and 3*b*, respectively) comprise frames 13 and 13', respectively. The frames 13, 13' surround the fins 11 of the respective louver in a plane parallel to the center plane whereas the fins 11 extend throughout the frames 13, 13'. The shape of the frames 13, 13' may correspond to the shape of the membrane or the chassis of the loudspeaker covered by the loudspeaker grille. Thus, the frames 13, 13' may be circular, oval, square, rectangular, or any other shape. As can be seen in FIG. 3, the frames 13, 13' may have a circular shape and during assembly of the grille the frame 13' of the inner louver 15 is attached to the frame 13 of the outer louver 10 so as to position the fins relative to each other as illustrated in FIG. 1.

In order to enhance the structural stability of the louvers 10, 15 stiffeners 14 may be provided which extend between or across the fins 11, thus coupling the fins 11 to each other and increasing stiffness of the louver. The stiffeners may be formed simultaneously with the fins using an appropriately shaped mold tool. In this case, the stiffeners are small "bridges" coupling neighboring fins to increase structural stiffness. For example, the stiffeners may extend between neighboring fins thereby forming a single member. Alternatively, the stiffeners may be formed separate from the fins, and the stiffeners may then be coupled to the fins.

Also illustrated in FIGS. 3*a* and 3*b* are drainage features provided to drain liquid dripping off the fins and gathering at the frame 13 of the outer louver. For at least this purpose, the louver 10 may be formed to include drainage apertures 17 that allow for the draining of liquid that drips off the fins. As can be seen from FIG. 3, the frame 13' of the inner louver 15 is, in an assembled state, positioned within the frame 13 of the outer louver 13, whereby the frames 13 and 13' are spaced by spacers 18, thus forming a drainage channel between the two frames for draining liquid which has penetrated the space between the two louvers 10, 15. Alternatively, the frame 13 of the outer louver 10 may be positioned within the frame 13' of the inner louver 15, or the frames may be coupled in any other configuration to create the drainage channel. The drainage apertures 17 can be arranged such that any possible "line of sight" through the grille is obstructed. In another example, gaps between the frames 13 and 13' may form the apertures 17.

Figure 4:
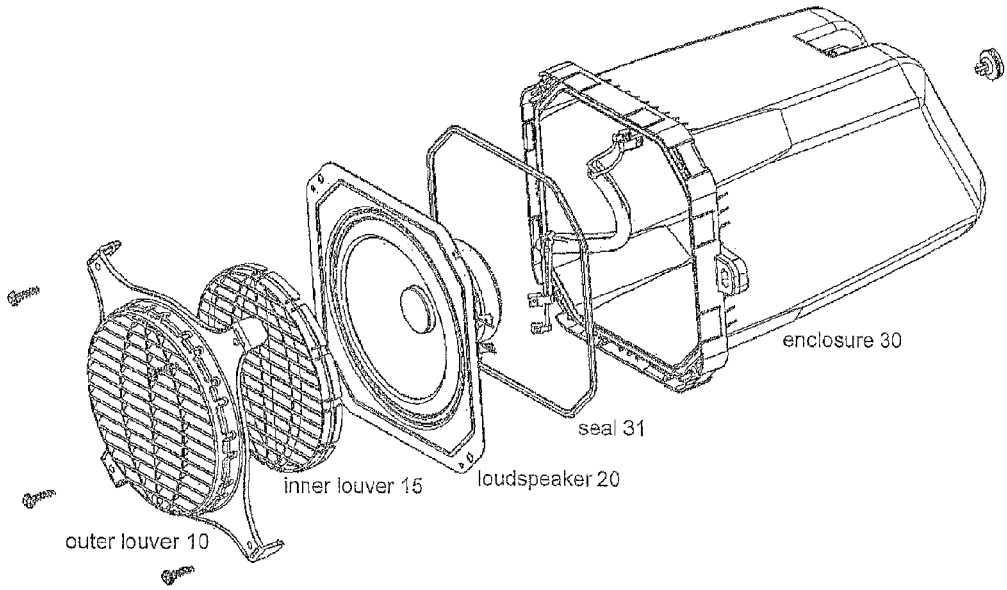
FIG. 4 is an exploded assembly drawing of an example loudspeaker system that includes a loudspeaker, an enclosure and a loudspeaker grille.
Figure 5:
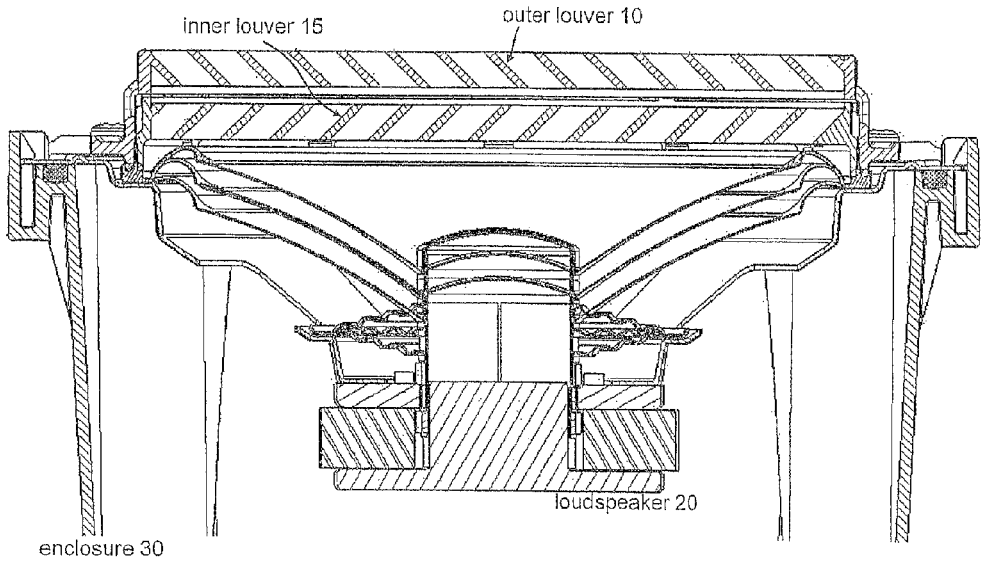
FIG. 5 is a perspective cross section through the assembly of FIG. 4.

Further, the frame of the outer louver 13 may include fastening means configured to attach the loudspeaker grille to a loudspeaker or a corresponding loudspeaker enclosure (see also FIGS. 4 and 5). The fastening means may include fasteners 16 which may be formed as clips such as for establishing snap-in connections or the like. Of course, other ways of attaching the grille to the loudspeaker or the loudspeaker enclosure may be appropriate.

FIG. 4 illustrates, by means of an exploded assembly drawing, the assembly of a loudspeaker system including a loudspeaker grille as discussed above with respect to FIGS. 1 to 3. FIG. 5 illustrates the assembled system by means of a perspective cross sectional view of the assembly. As can be seen from FIG. 4, the loudspeaker system includes an enclosure 30, which may be waterproof, and a loudspeaker 20, which may have a waterproof membrane and suspension. The loudspeaker 31 is inserted into an aperture of the housing 30 with a seal placed between the loudspeaker chassis and the enclosure, thus hermitically enclosing the loudspeaker driver. The loudspeaker 20 may be attached to the enclosure in different ways. In one exemplary system, the loudspeaker 20 is fixed to the enclosure 30 by means of a snap-in locking device.

The front of the loudspeaker such as the membrane, suspension and front portion of the chassis can be covered by a loudspeaker grille, as discussed above. The grille is composed by the outer louver 10 and the inner louver 15, and the inner louver 15 is positioned between the loudspeaker 20 and the outer louver 10. The grille may be fixed directly to the loudspeaker 20 or, alternatively, to the enclosure 30. In the present example, the fasteners 16 of the outer louver 10 are configured to snap on the enclosure 30. FIG. 5 illustrates the assembled system in a cross-sectional view.

Figure 6:
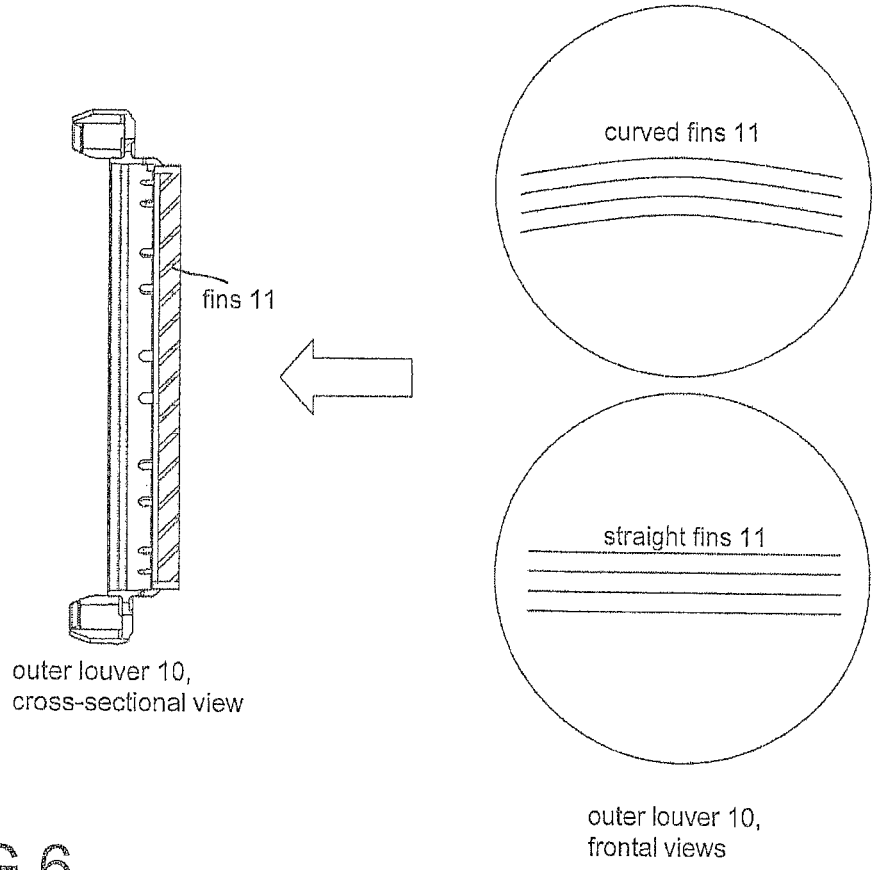
FIG. 6 includes a schematic cross-sectional view and schematic front views of example grilles illustrating shapes of the fins.

FIG. 6 illustrates a cross sectional view of the outer louver 10 and schematic frontal views of two alternative arrangements of the fins 11 which may be curved, bent or straight. Other designs of the fins 11 may be applicable, too. Further, the frame 13 of the outer louver 10 is circular in the illustrated examples. However, any other shape such as rectangular, square, and oval may also be used.

Although the present invention and its advantages have been described in detail, it should be understood that various changes, substitutions, and alterations can be made herein without departing from the spirit and scope of the invention as defined by the appended claims.

Moreover, the scope of the present application is not intended to be limited to the particular embodiments of the process, machine, manufacture, composition of matter, means, methods, and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A loudspeaker grille that comprises:

a louver arrangement formed substantially parallel to a center plane, and arranged in front of a chassis of a loudspeaker to protect a membrane and a suspension of the loudspeaker, the louver arrangement comprising a first louver and a second louver arranged on opposing sides of the center plane, where each of the first and second louvers comprise a plurality of fins which are arranged slanted with respect to the center plane and which are spaced such that a clearance is provided between projections of neighboring fins to the center plane, and entire surfaces of at least some of the fins of the first louver are inversely slanted to entire surfaces of at least some of the fins of the second louver.

2. The loudspeaker grille of claim 1, where the fins of the first louver are shifted in a lateral direction within the center plane with respect to the fins of the second louver.

3. The loudspeaker grille of claim 1 , where at least one of the first and second louvers comprises a frame that surrounds fins in a plane parallel to the center plane, the fins extending within the frame.

4. The loudspeaker grille of claim 3, where the frame is formed to include apertures that allow for draining of liquid that drips off the fins.

5. The loudspeaker grille of claim 1, where the fins of at least one of the first and second louvers are formed as elongated substantially flat bars arranged substantially in parallel to each other.

6. The loudspeaker grille of claim 5, where the elongated substantially flat bars are curved in a longitudinal direction and/or a lateral direction.

7. The loudspeaker grille of claim 1, where the first and second louvers comprise stiffeners extending between the fins to increase structural stiffness of the first and second louvers.

8. The loudspeaker grille of claim 1, where the fins of the first louver and the fins of the second louver are spaced such that a clearance is provided there between in a direction perpendicular to the center plane.

9. The loudspeaker grille of claim 1, where the fins of one louver do not overlap in a direction perpendicular to the center plane.

10. The loudspeaker grille of claim 3, where more than about 70 per cent of the area surrounded by the frame is open to let sound from the loudspeaker pass through.

11. The loudspeaker grille of claim 3, where the frame includes fasteners for fastening the grille to the loudspeaker or a loudspeaker enclosure.

12. The loudspeaker grille of claim 3, where the second louver is fixed within the frame of the first louver.

13. The loudspeaker grille of claim 1, where the fins of at least one of the first louver and the second louver are substantially planar surfaces.

14. The loudspeaker grille of claim 13, where the planar surfaces of the at least one of the first and second louvers are substantially parallel to one another.

15. The loudspeaker grille of claim 1, where the fins of the first and second louvers each have a slope relative to the center plane, the slope along the entire surface of the fins of the first louver is positive, and the slope along the entire surface of the fins of the second louver is negative.

16. The loudspeaker grille of claim 1, where at least one of the first and second louvers comprises a first fin having a first edge and a second fin having a second edge that neighbors the first edge of the first fin, where the first edge is positioned a first distance from the center plane and the second edge is positioned a second distance from the center plane different from the first distance.

17. The loudspeaker grille of claim 16, where the first distance is substantially different from the second distance.

18. The loudspeaker grille of claim 1, where a cross section of the fins of the first and the second louver comprises a curved cross section.

19. A loudspeaker system that comprises:

a loudspeaker comprising a chassis, a membrane, and a suspension coupling the membrane and the chassis; and a loudspeaker grille arranged in front of the loudspeaker to protect the membrane and the suspension included in the loudspeaker, the loudspeaker grille comprising:

a louver arrangement formed substantially parallel to a center plane, and comprising a first and a second louver arranged on opposing sides of the center plane; in the louver arrangement:

each of the first and second louvers comprises a plurality of fins, each fin formed as a planar member extending in a single plane, the fins arranged slanted with respect to the center plane and which are spaced such that a clearance is provided between projections of neighboring fins to the center plane; and the fins of the first louver are inversely slanted with respect to the fins of the second louver.

20. The loudspeaker system of claim 19 further comprising an enclosure providing an aperture which is configured to receive the loudspeaker.

21. The loudspeaker system of claim 20 where the loudspeaker grille includes fasteners for fastening the grille to the enclosure.

* * * * *